US011555601B2

(12) United States Patent
Spahnie et al.

(10) Patent No.: US 11,555,601 B2
(45) Date of Patent: Jan. 17, 2023

(54) APPARATUS FOR MOUNTING LIGHT SOURCES IN LIGHT FIXTURES AND METHOD OF ASSEMBLY THEREOF

(71) Applicant: CURRENT LIGHTING SOLUTIONS, LLC, East Cleveland, OH (US)

(72) Inventors: Brian Morgan Spahnie, East Cleveland, OH (US); Xin Wang, Shanghai (CN)

(73) Assignee: CURRENT LIGHTING SOLUTIONS, LLC, Beachwood, OH (US)

( * ) Notice: Subject to any disclaimer, the term of this patent is extended or adjusted under 35 U.S.C. 154(b) by 0 days.

(21) Appl. No.: 17/271,738

(22) PCT Filed: Aug. 27, 2019

(86) PCT No.: PCT/US2019/048323

§ 371 (c)(1),
(2) Date: Feb. 26, 2021

(87) PCT Pub. No.: WO2020/046919

PCT Pub. Date: Mar. 5, 2020

(65) Prior Publication Data

US 2022/0128225 A1 Apr. 28, 2022

Related U.S. Application Data

(60) Provisional application No. 62/723,249, filed on Aug. 27, 2018.

(51) Int. Cl.

| | |
|---|---|
| ***F21V 21/14*** | (2006.01) |
| ***G09F 13/04*** | (2006.01) |
| ***F21Y 115/10*** | (2016.01) |

(52) U.S. Cl.
CPC ..... *F21V 21/14* (2013.01); *G09F 13/0404* (2013.01); *G09F 13/0445* (2021.05); *F21Y 2115/10* (2016.08)

(58) Field of Classification Search
CPC .. F21V 21/14; G09F 13/0404; G09F 13/0445; G09F 13/00; F21Y 2115/10
See application file for complete search history.

(56) References Cited

U.S. PATENT DOCUMENTS 4,299,042 A * 11/1981 Rasmussen ..... G09F 7/00 40/571
5,435,087 A * 7/1995 Karkar ..... G09F 13/04 40/575

(Continued)

FOREIGN PATENT DOCUMENTS

KR 10-1472726 B1 12/2014
KR 10-2017-0114862 A 4/2016

(Continued)

OTHER PUBLICATIONS

International Search Report and Written Opinion dated Dec. 16, 2019 which was issued in connection with a counterpart PCT Application No. PCT/US2019/048323 which was filed on Aug. 27, 2019.

*Primary Examiner* — Peggy A Neils
(74) *Attorney, Agent, or Firm* — Buckley, Maschoff & Talwalkar LLC

(57) ABSTRACT

There are provided an apparatus for mounting a light source in a light fixture and method of assembly of the apparatus. For example, there is provided an apparatus for mounting a light source in a light fixture. The apparatus includes an adjustable fixture including a rail onto which the light source is disposed. The apparatus further includes a spacer disposed perpendicularly to the rail. The spacer also includes a fixture (Continued)

300 configured to lock the apparatus in a specified configuration that corresponds to a depth of a frame of the light fixture.

20 Claims, 3 Drawing Sheets

(56) References Cited

U.S. PATENT DOCUMENTS

| | | | | |
|---|---|---|---|---|
| 6,298,589 | B1 * | 10/2001 | Hillstrom | G09F 13/0413 40/574 |
| 10,203,098 | B1 * | 2/2019 | Pan | F21V 33/0024 |
| 2012/0063138 | A1 | 3/2012 | Leadford et al. | |
| 2013/0077300 | A1 * | 3/2013 | Meyer | F21V 5/04 362/235 |
| 2015/0312975 | A1 * | 10/2015 | Tischler | F21V 23/06 315/294 |
| 2016/0209007 | A1 | 7/2016 | Belmonte et al. | |

FOREIGN PATENT DOCUMENTS

| | | | | |
|---|---|---|---|---|
| KR | 20-2016-0003190 U | | 9/2016 | |
| WO | WO 2013/022952 | * | 2/2013 | G09F 13/22 |

* cited by examiner

APPARATUS FOR MOUNTING LIGHT SOURCES IN LIGHT FIXTURES AND METHOD OF ASSEMBLY THEREOF

BACKGROUND

A typical box sign (or generally a light fixture) can include light sources that are mounted into it to confer functionality to the sign. One such box sign can be a double-sided box sign that is made of a single metallic long bar or stick fitted with light sources on its surfaces. For example, and not by limitation, these light sources may be light emitting diodes (LEDs).

One issue that arises in these typical box signs is that the depth between the light sources and the sign's face cannot be adjusted properly. Specifically, the depth between light sources and the sign's face cannot be adjusted without altering a preset brightness and/or uniformity for the box sign; this issue is especially pronounced for box signs having big depths. Thus, this can lead to significant installation time that is spent on altering the light fixture, and even when a solution is found, it may not be reliable.

SUMMARY

Accordingly, given the aforementioned issues, there is a need for a quick and reliable mechanism(s) to install light sources into a box sign. Specifically, there is a need for mounting light sources without comprising a preset brightness and/or uniformity for a box sign, regardless of its depth. The embodiments described herein mitigate or solve these and other issues in the art. Specifically, the embodiments alleviate the difficultly of fitting a light bar into a box sign having multiple depths or relatively large depths in order to provide the appropriate brightness and uniformity.

An exemplary apparatus for mounting a light source in a light fixture is provided herein. The apparatus includes an adjustable fixture including a rail onto which the light source is disposed. The apparatus further includes a spacer disposed perpendicularly to the rail, and the spacer also includes a fixture configured to lock the apparatus in a specified configuration that corresponds to a depth of a frame of the light fixture.

One exemplary method is provided for mounting a light source in a light fixture. The method includes providing an adjustable fixture including a rail onto which the light source is disposed. The method further includes providing a spacer disposed perpendicularly to the rail. The spacer includes a fixture configured to lock the apparatus in a specified configuration. The method further includes adjusting the configuration to correspond to a depth of a frame of the light fixture.

The exemplary embodiments may be used, for example and not by limitation, in a double sided box sign to quickly and easily provide uniform and bright light output on the sign's faces. For example, and not by limitation, the box sign's depth might be varied from about one foot to about three feet, or, in some embodiments, to depths that are greater than about three feet.

Additional features, modes of operations, advantages, and other aspects of various embodiments are described below with reference to the accompanying drawings. It is noted that the present disclosure is not limited to the specific embodiments described herein. These embodiments are presented for illustrative purposes only. Additional embodiments, or modifications of the embodiments disclosed, will be readily apparent to persons skilled in the relevant art(s) based on the teachings provided.

BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

DETAILED DESCRIPTION

Figure 1:
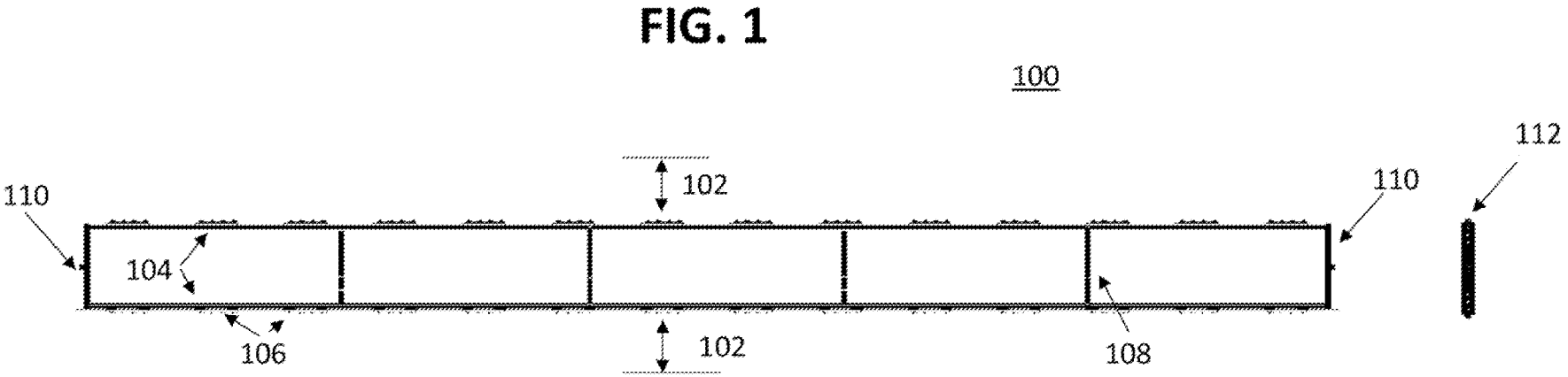
FIG. 1 illustrates an apparatus for mounting light sources on a light fixture.

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

FIG. 1 illustrates a top view of an apparatus 100 and a side view 112 of the apparatus 100. The apparatus 100 is configured to be mounted on a box sign or light fixture such as that the box sign or light fixture may be fitted with a set of light sources, independent of its depth. The box sign or light fixture may be, for example and not by limitation, a linear fluorescent light (LFL) fixture.

As shown in FIG. 1, the box sign has a depth indicated by distance 102 on either side of the apparatus 100. In one embodiment, the apparatus 100 can be extended in a first direction on either side, or generally on at least one side, to fit the box sign by reducing the distances 102. The apparatus 100 can also extend in a second direction perpendicular to the first direction such that the apparatus 100 fits the box sign by mating the endcaps 110 of the apparatus 100 to sides of the box sign.

The apparatus 100 includes a set of rails 104 configured to provide the apparatus 100 the ability to extend in the second direction and to serve as a support for a set of light sources 106. In one example, and not by limitation, the set of light sources 106 can be a set of light emitting diodes. The apparatus 100 further includes a set of spacers 108. In one exemplary embodiment, each spacer 108 may be equidistant from an immediately neighboring spacer 108.

Furthermore, each spacer 108 may be fitted with a set of stops at which apparatus 100 can be locked to provide a specific depth when extended in the first direction. The stops may achieve, for example and not by limitation, utilizing recesses machined in the frame of the spacer 108. The set of rails 104 may include a corresponding feature that mates with recesses that, for example, once pushed down or otherwise engaged, locks the apparatus 100 in a specific position (i.e. in a position corresponding to a specific depth of the box sign).

Figure 2:
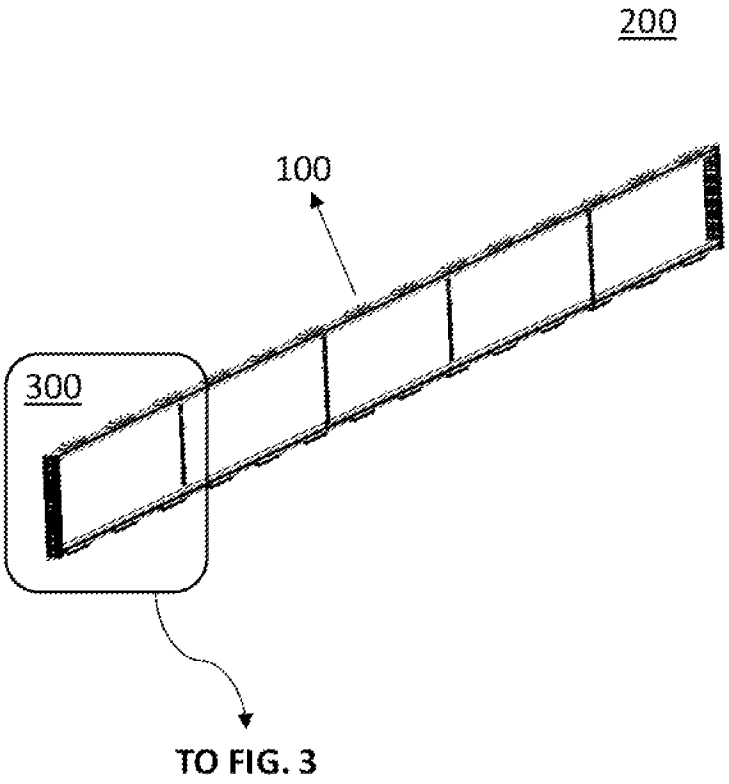
FIG. 2 illustrates another view of an apparatus for mounting light sources on a light fixture.
Figure 3:
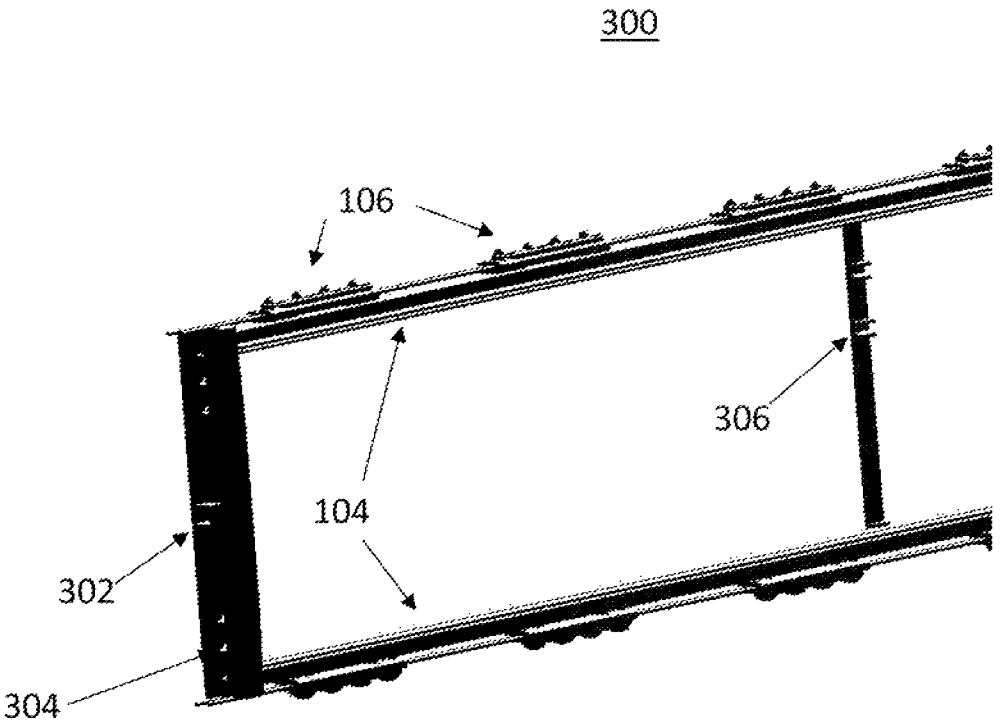
FIG. 3 illustrates yet another view of an apparatus for mounting light sources on a light fixture.

FIG. 2 illustrates a perspective view 200 of the apparatus 100, and FIG. 3 illustrates a detailed view of one section 300 of the apparatus 100. The section 300 is an end section of the apparatus 100 and includes an LFL lamp socket 302. As such, when the box sign is an LFL fixture, the apparatus 100 can serve to replace typically tubular fluorescent bulbs with the set of light sources 106 provided with the apparatus 100.

The end section further includes a set of features 304 configured to provide a specific depth to the apparatus 100, making it adaptable to light fixtures having an arbitrary depth. Furthermore, as shown in the section 300, the spacer 108 can include features 306 (such as, for example, the stops described above) that are further configured to lock the apparatus 100 in a specific configuration, consistent with the depth of a particular box sign.

Those skilled in the relevant art(s) will appreciate that various adaptations and modifications of the embodiments described above can be configured without departing from the scope and spirit of the disclosure. Therefore, it is to be understood that, within the scope of the appended claims, the teachings featured herein may be practiced other than as specifically described herein.

What is claimed is:

1. An apparatus for mounting a light source in a light fixture, the apparatus comprising:

an adjustable fixture including a rail onto which the light source is disposed;

a spacer disposed perpendicularly to the rail, the spacer including a fixture configured to lock the apparatus in a specified configuration, wherein the spacer is configured to extend or retract in a direction approximately perpendicular to the rail;

wherein the specified configuration corresponds to a depth of a frame of the light fixture.

2. The apparatus of claim 1, wherein the light source is a light emitting diode (LED).

3. The apparatus of claim 1, wherein the rail is fitted with a set of light sources comprising the light source.

4. The apparatus of claim 3, wherein the set of light sources is a set of light emitting diodes (LEDs).

5. The apparatus of claim 1, wherein the adjustable fixture is extendable in a direction parallel to the spacer.

6. The apparatus of claim 1, wherein the adjustable fixture further includes a first endcap and a second endcap.

7. The apparatus of claim 6, wherein the at least one of the first endcap and the second endcap includes a socket configured to mate with a connector of the light fixture.

8. The apparatus of claim 6, wherein at least one of the first endcap and the second endcap includes one or more features configured to lock the apparatus in the specified configuration.

9. The apparatus of claim 1, wherein the depth is between about 1 foot and about 3 feet.

10. The apparatus of claim 1, wherein the depth is greater than 3 feet.

11. A method for mounting a light source in a light fixture, the method comprising:

providing an adjustable fixture including a rail onto which the light source is disposed;

providing a spacer disposed perpendicularly to the rail, the spacer including a fixture configured to lock the apparatus in a specified configuration, wherein the spacer is configured to extend or retract in a direction approximately perpendicular to the rail, adjusting the configuration to correspond to a depth of a frame of the light fixture.

12. The method of claim 11, wherein the light source is a light emitting diode (LED).

13. The method of claim 11, further comprising fitting the rail with a set of light sources comprising the light source.

14. The method of claim 11, wherein adjusting the configuration includes extending the adjustable fixture in a direction parallel to the spacer.

15. The method of claim 14, wherein adjusting the configuration further includes extending the adjustable fixture in another direction perpendicular to the direction parallel to the spacer.

16. The method of claim 11, further including mating a socket of at least one of a first endcap and a second endcap of the adjustable fixture with a connector of the light fixture.

17. The method of claim 11, further including locking the adjustable fixture using a feature on at least one of a first endcap and a second endcap of the adjustable fixture.

18. The method of claim 11, further including adjusting the adjustable fixture to a specified depth of the light fixture corresponding to the depth being between about 1 foot and about 3 feet.

19. The method of claim 11, further including adjusting the adjustable fixture to a specified depth of the light fixture corresponding to the depth being between greater than about 3 feet.

20. The method of claim 11, further including adjusting the adjustable fixture to a specified depth of the light fixture corresponding to the depth being between greater than about 1 foot.

* * * * *